US009208978B2

(12) United States Patent
Yano et al.

(10) Patent No.: US 9,208,978 B2
(45) Date of Patent: Dec. 8, 2015

(54) ELECTROMAGNETIC OPERATING DEVICE

(75) Inventors: Tomotaka Yano, Chiyoda-ku (JP); Kyoichi Otsuka, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 44 days.

(21) Appl. No.: 14/115,739

(22) PCT Filed: Sep. 12, 2011

(86) PCT No.: PCT/JP2011/070716

§ 371 (c)(1),
(2), (4) Date: Nov. 5, 2013

(87) PCT Pub. No.: WO2013/005348

PCT Pub. Date: Jan. 10, 2013

(65) Prior Publication Data

US 2014/0076851 A1 Mar. 20, 2014

(30) Foreign Application Priority Data

Jul. 7, 2011 (JP) ..... 2011-150685

(51) Int. Cl.
*H01H 33/38* (2006.01)
*H01H 33/40* (2006.01)
(Continued)

(52) U.S. Cl.
CPC ..... *H01H 33/38* (2013.01); *H01H 9/16* (2013.01); *H01H 33/40* (2013.01); *H01H 33/666* (2013.01)

(58) Field of Classification Search
CPC . H01H 31/003; H01H 33/022; H01H 33/666; H01H 33/661; H01H 2003/6668; H01H 33/28; H01H 33/38; H01H 33/40; H01H 33/42; H01H 9/16; H02B 11/10; H02B 11/127; H02B 11/133; H02K 37/14
USPC ..... 218/119, 120, 121, 140, 154; 200/50.21, 50.26, 440; 335/6, 92, 103; 361/133, 605, 135
See application file for complete search history.

(56) References Cited

U.S. PATENT DOCUMENTS 3,787,649 A * 1/1974 Goodwin et al. ..... 200/400
5,912,604 A * 6/1999 Harvey et al. ..... 335/9
(Continued)

FOREIGN PATENT DOCUMENTS

CN 1319864 A 10/2001
CN 1728307 A 2/2006
(Continued)

OTHER PUBLICATIONS

International Search Report (PCT/ISA/210) mailed on Dec. 13, 2011, by the Japanese Patent Office as the International Searching Authority for International Application No. PCT/JP2011/070716.
(Continued)

*Primary Examiner* — Renee Luebke
*Assistant Examiner* — William Bolton
(74) *Attorney, Agent, or Firm* — Buchanan Ingersoll & Rooney PC

(57) ABSTRACT

An electromagnet mechanism is coaxially disposed with a vacuum interrupter that is disposed in a circuit breaker, and has a movable core and a fixed core facing each other and an electromagnetic coil that makes the movable core and the fixed core separate or come into contact in response to electromagnetic force. A driving rod which is movably disposed in the axial direction of the electromagnet mechanism is coupled to the movable core, and in which one side is coupled to the circuit breaker and the other side passes through an opening side end plate of the electromagnet mechanism to be extended outward from the opening side end plate of the electromagnet mechanism. An indication unit is disposed on the opening side end plate of the electromagnet mechanism, and indicates a state of the circuit breaker in conjunction with the movement of the driving rod.

8 Claims, 10 Drawing Sheets

(51) Int. Cl.
*H01H 33/666* (2006.01)
*H01H 9/16* (2006.01)

(56) References Cited

U.S. PATENT DOCUMENTS

| | | | | |
|---|---|---|---|---|
| 6,020,567 | A * | 2/2000 | Ishikawa et al. | 218/154 |
| 6,198,062 | B1 * | 3/2001 | Mather et al. | 218/152 |
| 6,373,675 | B1 * | 4/2002 | Yamazaki et al. | 361/135 |
| 6,753,493 | B2 * | 6/2004 | Rhein et al. | 218/120 |
| 2001/0025830 | A1 * | 10/2001 | Allard et al. | 218/118 |
| 2002/0179571 | A1 | 12/2002 | Rhein et al. | |
| 2006/0028073 | A1 | 2/2006 | Sugino et al. | |
| 2012/0169441 | A1 * | 7/2012 | Kim et al. | 335/179 |
| 2012/0274428 | A1 * | 11/2012 | Reuber et al. | 335/6 |

FOREIGN PATENT DOCUMENTS

| | | | |
|---|---|---|---|
| EP | 1 416 503 | A2 | 5/2004 |
| JP | 61-171017 | A | 8/1986 |
| JP | 63-49736 | U | 4/1988 |
| JP | 2002-140966 | A | 5/2002 |
| JP | 2004-152625 | A | 5/2004 |
| JP | 2005-78971 | A | 3/2005 |
| JP | 2006-40615 | A | 2/2006 |
| JP | 2009-21124 | A | 1/2009 |

OTHER PUBLICATIONS

Chinese First Office Action dated May 27, 2015 issued in the corresponding Chinese Patent Application No. 201180071730.5 and English translation (12 pages).

Australian Patent Examination Report No. 2 dated Jun. 3, 2015 issued in the corresponding Australian Patent Application No. 2011372573 (3 pages).

* cited by examiner

ELECTROMAGNETIC OPERATING DEVICE

TECHNICAL FIELD

The present invention relates to an electromagnetic operating device and, more particularly, relates to an electromagnetic operating device which operates a power switchgear by electromagnetic force to perform opening and closing operation, the power switchgear being equipped with, for example, a tank type vacuum circuit breaker for use in electric power transmission/distribution of electric power facilities, electric power reception facilities, and the like.

BACKGROUND ART

There is known one shown in FIG. 9 and FIG. 10, as a conventional electromagnetic operating device which operates a power switchgear by electromagnetic force to perform opening and closing operation, the power switchgear being equipped with, for example, a vacuum circuit breaker. FIG. 9 is a front view; and FIG. 10 is a side view.

In FIG. 9 and FIG. 10, the electromagnetic operating device includes a case 10 formed in a box shape; the case 10 has an opening 12 on the front side; and a front cover (not shown in the drawing) is attachably and detachably fixed on the front side of the case 10. Within the case 10, a capacitor 16 and a control substrate 18 are separately and independently arranged centering on an electromagnet 14, respectively; the electromagnet 14 is fixed at the bottom side center of the case with bolts and nuts; and the capacitor 16 and the control substrate 18 are separately fixed to facing lateral faces of the case, respectively. More specifically, the capacitor 16 is fixed to the left lateral face of the case 10 with bolts and nuts; and the control substrate 18 is fixed to the right lateral face of the case 10 via spacers 20 with bolts and nuts.

The case 10 incorporates a secondary plug 22 and cables 24, 26, 28, and 30 and also incorporates an auxiliary contact 34, an indication plate 36, and a counter 38, which serve as a state detection mechanism that detects a state of a vacuum circuit breaker (vacuum interrupter) 32 serving as a switchgear. The cable 26 is connected to the auxiliary contact 34; and the cable 30 is connected to a coil 48 of the electromagnet 14.

The control substrate 18 receives a supply of electric power from a secondary plug 22 and also receives a signal by a closing command or a contact opening command (interrupting command) from a digital relay or an analog relay; and the control substrate 18 is mounted with a control logic unit that performs logical operation for controlling driving of the electromagnet 14, a charging and discharging circuit for charging and discharging the capacitor 16, and a relay and a relay contact for controlling the energization direction of the coil (electromagnet coil) 48, and the like (not shown in the drawing). Further, the control substrate 18 is mounted with a light-emitting diode 50 which shows that charging of the capacitor 16 is completed; and the control substrate 18 is mounted with an push button for "ON" (push button switch) 52 which is for commanding closing to the vacuum interrupter 32 by a manual operation and an push button for "OFF" (push button switch) 54 which is for outputting a contact opening command (interrupting command) to the vacuum interrupter 32 by a manual operation.

The auxiliary contact 34, the indication plate 36, and the counter 38 are arranged on the upper side of the electromagnet 14 and are coupled to a plate 56, respectively, as a state detection mechanism of the vacuum circuit breaker 32, resulting in a configuration integrated with the electromagnet 14.

The electromagnet 14 includes a movable core 58, a fixed core 60, the coil 48, a shaft 62, two movable flat plates 64 and 66, a permanent magnet 68, iron covers 70 and 72 formed in a tubular shape, iron support plates 74 and 76, a fixing rod 78, and the like. The coil (electromagnet coil) 48 is incorporated in a coil bobbin 48*a* disposed between the support plate 74 and the support plate 76. The fixing rod 78 is fixed to the bottom side of the case 10 with bolts and nuts and is also fixed to a base 80.

The shaft 62 is disposed at a central portion of the electromagnet 14 and is also set along a vertical direction. Furthermore, a configuration is made such that the upper side of the shaft 62 is inserted into a through hole 82 of the plate 66 and the lower side thereof is inserted into a through hole 84 of the support plate 76 to be movable up and down and slidable. The movable core 58 and the movable flat plates 64 and 66 are fixed to the outer circumferential surface of the shaft 62 with nuts; and a shaft 88 is coupled to the lower side of the shaft 62 via a pin 86.

Further, a support plate 90 is coupled to the lower side of the shaft 62; and a ring-shaped interrupting spring 92 that draws a circle centered on the axial center of the shaft 62 is mounted between the support plate 90 and the base 80. The interrupting spring 92 applies an elastic force, which is for separating the movable core 58 from the fixed core 60, to the shaft 62 via the support plate 90. Furthermore, the permanent magnet 68 is disposed around the movable core 58 and is fixed to the mounting plate 74. The fixed core 60 is fixed to the mounting plate 76 with bolts.

Furthermore, the lower side of the shaft 88 is coupled to a pair of levers 96 via a pin 94. The lever 96 is configured as one element of a linking mechanism that converts the transmission direction of a driving force associated with electromagnetic force generated by the electromagnet 14 and is coupled to a lever 100 via the shaft 98. The lever 100 is coupled to a joining plate 104 via a pin 102.

The joining plate 104 is inserted into an insulation pedestal 110 fixed to the base 80 so as to be capable of moving upward and downward (reciprocating); and a contact pressure spring holding member 112 is formed on the upper side of the joining plate 104. The contact pressure spring holding member 112 is formed with a through hole; and an axial end portion of an insulation rod 114 is inserted into the through hole. A contact pressure spring 120 is mounted between the contact pressure spring holding member 112 and the bottom side of the insulation rod 14.

The upper side of the insulation rod 114 is coupled to a movable feeder 122 via a flexible conductor 121 and is coupled to a movable conductor 124 of the vacuum interrupter 32. The movable conductor 124 is coupled to a movable contact (not shown in the drawing) and a fixed contact (not shown in the drawing) is disposed facing the movable contact. The fixed contact is coupled to a fixed conductor 126 and is incorporated in an insulation cylinder 128 together with the movable contact.

In this case, when the closing command is input to the control substrate 18, the coil (electromagnet coil) 48 of the electromagnet 14 is energized by the signal from the control substrate 18; a magnetic field is formed around the coil 48 by a path connecting the movable core 58, the fixed core 60→the mounting plate 76→the cover 72→the mounting plate 74→and the movable core 58; a downward suction force is exerted on the bottom side end face of the movable core 58; the movable core 58 moves to the fixed core 60 side; and the movable core 58 is suctioned to the fixed core 60. At this time, the direction of the magnetic field formed by the permanent magnet 68 is also the same as the direction of the magnetic field generated associated with excitation of the coil 48; and therefore, the movable core 58 moves to the fixed core 60 side in a state where the suction force is enhanced.

When a closing operation (suction operation) by the electromagnet 14 is performed, the shaft 62 moves downward against the elastic force of the interrupting spring 92 and the driving force associated with the electromagnetic force generated by the electromagnet 14 is transmitted to the lever 96. The driving force is transmitted to the joining plate 104 via the shaft 98 and the lever 100; the movable conductor 124 moves upward; the movable contact comes into contact with the fixed contact; and a closing operation of the vacuum interrupter 32 is performed. In the closing operation of the vacuum circuit breaker 32, the contact pressure spring 120 is not compressed until the movable contact comes into contact with the fixed contact; however, when the movable contact comes into contact with the fixed contact, the contact pressure spring 120 is compressed; and after that, the contact pressure spring 120 continues to be compressed until the closing operation is completed. On the other hand, the interrupting spring 92 continues to be consistently compressed during the closing operation of the vacuum interrupter 32.

Next, when the contact opening command (interrupting command) is input to the control substrate 18 and the signal associated with the contact opening command is output from the control plate 18 to the coil 48, a current in a direction opposite to that at the time of closing flows through the coil 48 and a magnetic field in a direction opposite to that at the time of closing operation is formed around the coil 48. In this case, magnetic flux generated by the coil 48 and magnetic flux generated by the permanent magnet 68 are cancelled out with each other and a suction force at the axial end face (lower face) of the movable core 58 is weaker than an elastic force generated by the interrupting spring 92 and the contact pressure spring 120; and therefore, the movable core 58 is separated from the fixed core 60 to move in the upward direction.

When the shaft 62 moves upward associated with the movement of the movable core 58, the joining plate 104 moves downward in conjunction with the upward movement of the lever 96, the movable contact of the vacuum interrupter 32 is separated from the fixed contact, the contact between the fixed contact and the movable contact is released, and a contact opening operation (interrupting operation) of the vacuum interrupter 32 is performed. In this case, when the retention of a closing state of the electromagnet 14 is released, first, the compressed contact pressure spring 120 extends. Then, when the contact pressure spring holding member 112 comes into contact with a washer 116, the contact between the fixed contact and the movable contact of the vacuum interrupter 32 is released, and the interrupting operation of the vacuum circuit breaker 32 and interrupting (opening) operation of the electromagnet 14 are performed simultaneously.

In the process in which the closing operation or the contact opening operation (interrupting operation) by the vacuum interrupter 32 is performed, a closing or interrupting state of the vacuum interrupter 32 is detected by the auxiliary contact 34, the indication plate 36, and the counter 38.

The auxiliary contact 34 is structured such that a normally open contact is ON (closed) when a shaft 142 rotates in one direction and a normally close contact is OFF (opened) when the shaft 142 rotates in a reverse direction. In this case, a lever 138 is formed with a long hole and a pin 136 is inserted into the long hole; and thus, the shaft 142 can be rotated in accordance with the upward and downward movement of the a shaft 62 and ON/OFF of the normally open contact and the normally close contact can be performed in accordance with the rotational operation of the shaft 142.

The indication plate 36 is integrally formed with the leading end side of the lever 140. Then, a letter of "OFF" is marked on the upper side of the front side of the indication plate 36 and a letter of "ON" is marked on the lower side thereof. The letter of "OFF" is visible from the front side of the case 10 when the indication plate 36 is located at a position shown in FIG. 10; and the letter of "ON" is visible from the front side of the case 10 when the indication plate 36 moves upward from the position shown in FIG. 10. More specifically, the configuration is made such that the letter of "OFF" or "ON" is seen from the front side of the case 10 in accordance with the upward and downward movement of the shaft 62.

Furthermore, a spring 148 is disposed on the indication plate 36; one end side of the spring 148 is coupled to an axial end portion of the lever 140 and the other end side is coupled to the counter lever 150 of the counter 38. The spring 148 expands and contracts in response to the rotation of the lever 140; the counter lever 150 rotates centering on a pin 152 and the number of opening and closing operation times of the vacuum interrupter 32 is mechanically counted each time the counter lever 150 rotates.

PRIOR ART DOCUMENT

Patent Document

Patent Document 1: Japanese Unexamined Patent Publication No. 2004-152625

SUMMARY OF THE INVENTION

Problems to be Solved by the Invention

In the aforementioned conventional electromagnetic operating device, the capacitor 16 and the control substrate 18 are separately and independently arranged centering on the electromagnet 14, respectively, within the case 10; and the electromagnet 14 is fixed at the bottom side center of the case with bolts and nuts. Then, the auxiliary contact 34, the indication plate 36, and the counter 38 are arranged on the upper side of the electromagnet 14 and are coupled to the plate 56, respectively, resulting in the configuration integrated with the electromagnet 14.

Furthermore, the electromagnet 14 includes the movable core 58, the fixed core 60, the coil 48, the shaft 62, and the like. Further, the support plate 90 is coupled to the lower side of the electromagnet 14, that is, the lower side of the shaft 62; and the ring-shaped interrupting spring 92 that draws a circle centered on the axial center of the shaft 62 is mounted between the support plate 90 and the base 80. The interrupting spring 92 applies the elastic force, which is for separating the movable core 58 from the fixed core 60, to the shaft 62 via the support plate 90.

The configuration is made in such a manner that the auxiliary contact 34, the indication plate 36, and the counter 38 are arranged on the upper side of the electromagnet 14 via the plate 56 and the interrupting spring 92 is disposed on the lower side of the electromagnet 14 via the support plate 90; and accordingly, there is a problem in that it results in an increase in size due to an increase in the number of components and an increase in arrangement space in a vertical direction.

Furthermore, the configuration is made such that three phase vacuum interrupters 32 are arranged for three phases in parallel to each other with a predetermined distance spaced; one driving shaft, which drives movable shafts of the three phase vacuum interrupters 32 collectively in three phases, is provided in a direction perpendicular to axial directions of the three phase vacuum interrupters 32; this one driving shaft pivots by the electromagnetic operating device coupled to the driving shaft; and thus, the respective movable shafts of the three phase vacuum interrupters 32 are driven collectively, opening and closing of the fixed contacts and the movable contacts of the three phase vacuum interrupters 32 is performed collectively in three phases, and the vacuum interrupters 32 are opened and closed simultaneously in three phases. Accordingly, there is a problem in that it results in an integrated assembling work of the vacuum interrupter 32 and the electromagnetic operating device; and thus, work efficiency becomes bad and the adjustment for opening and closing states for each phase of the vacuum interrupter 32 is difficult. Furthermore, a problem exists in that application to a single phase circuit breaker is difficult.

The present invention has been made to solve the above described problem, and an object of the present invention is to provide an electromagnetic operating device capable of achieving a reduction in size and capable of dealing with a single phase and three phases.

Means for Solving the Problems

According to the present invention, there is provided an electromagnetic operating device including: an electromagnet mechanism which performs opening and closing operation of a circuit breaker and is coaxially disposed with a vacuum valve that is disposed in the circuit breaker, and which has a movable core and a fixed core arranged facing with each other and has an electromagnetic coil that makes the movable core and the fixed core separate or come into contact in response to electromagnetic force; an electromagnetic operation rod which is movably disposed in the axial direction of the electromagnet mechanism and is coupled to the movable core, and in which one side is coupled to the circuit breaker and the other side passes through an opening side end plate of the electromagnet mechanism to be extended outward from the opening side endplate of the electromagnet mechanism; and an indication unit which is disposed on the opening side end plate of the electromagnet mechanism and indicates a state of the circuit breaker in conjunction with the movement of the electromagnetic operation rod.

Advantageous Effect of the Invention

According to the electromagnetic operating device of the present invention, there can be obtained the electromagnetic operating device capable of achieving a reduction in size and capable of dealing with a single phase and three phases.

MODE FOR CARRYING OUT THE INVENTION

Embodiment 1

Figure 1:
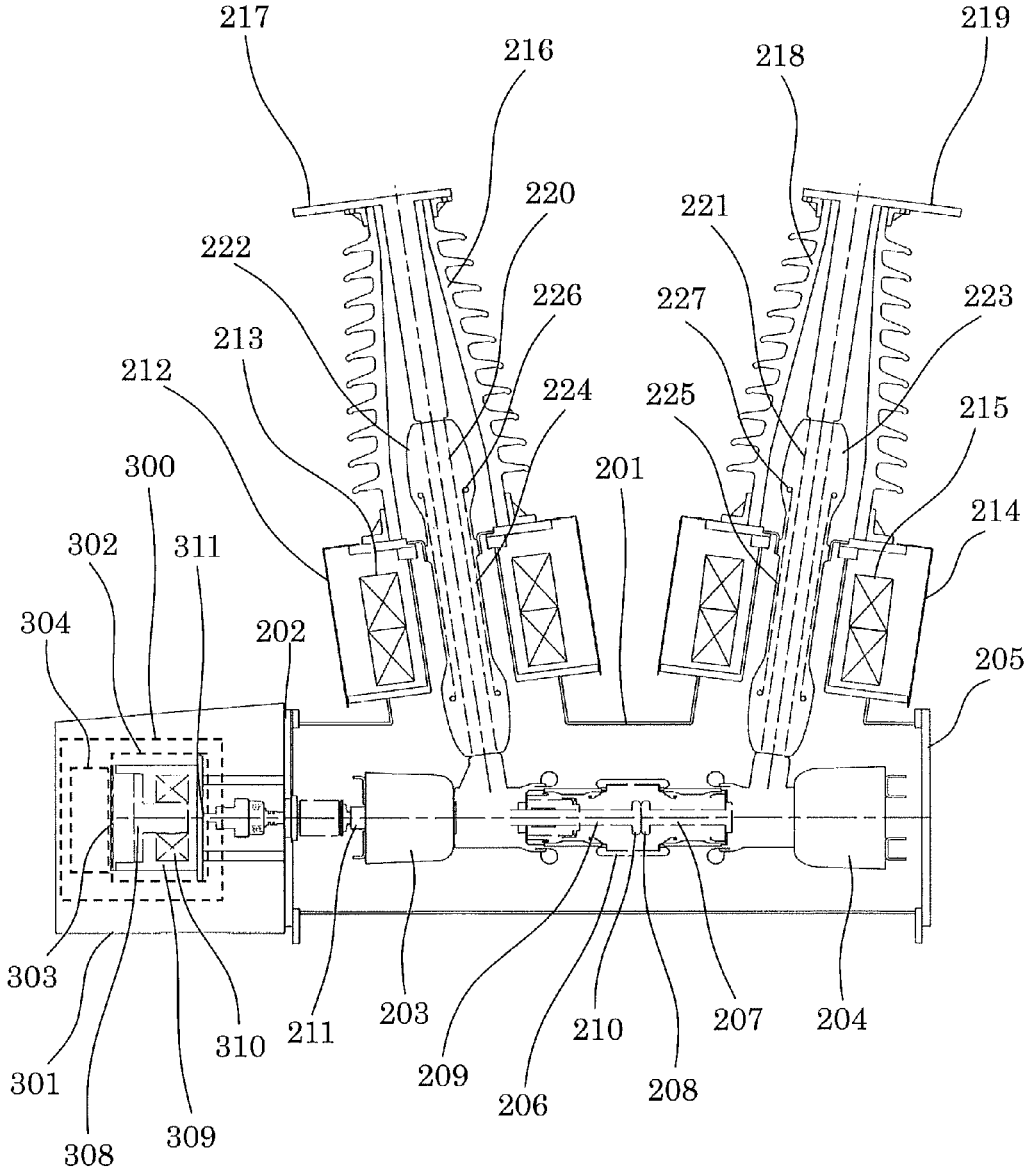
FIG. 1 is a side sectional view showing a circuit breaker equipped with an electromagnetic operating device according to Embodiment 1 of the present invention.
Figure 2:
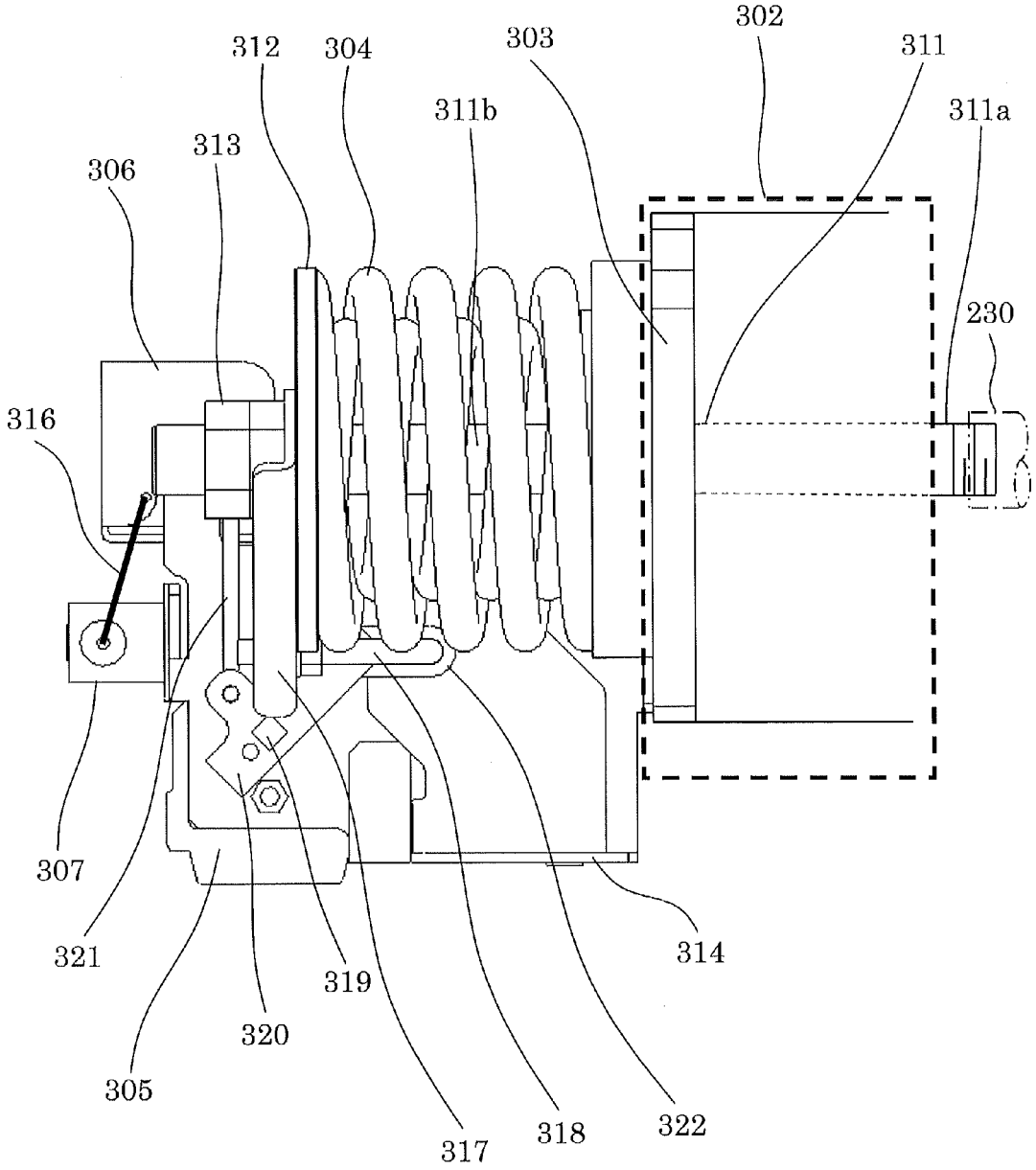
FIG. 2 is a side view showing an ON state in the electromagnetic operating device according to Embodiment 1 of the present invention.
Figure 3:
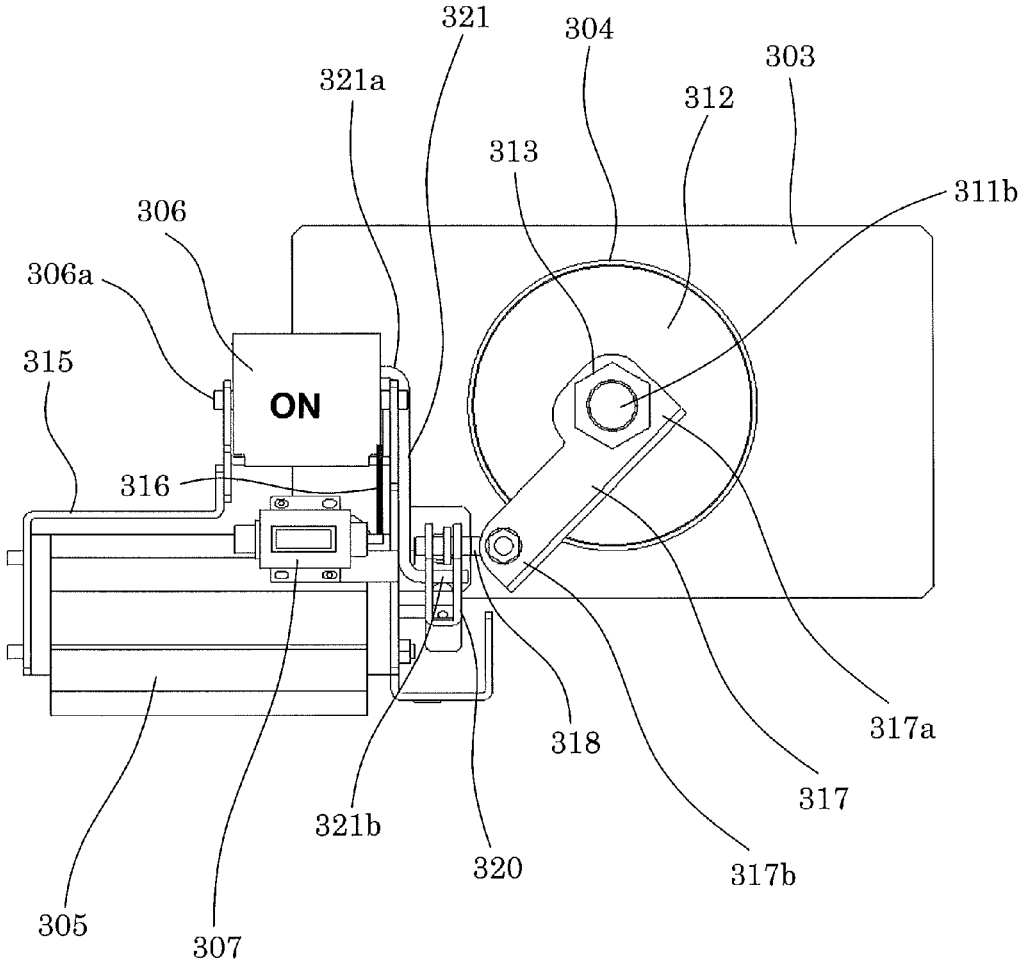
FIG. 3 is a front view showing the ON state in the electromagnetic operating device according to Embodiment 1 of the present invention.
Figure 4:
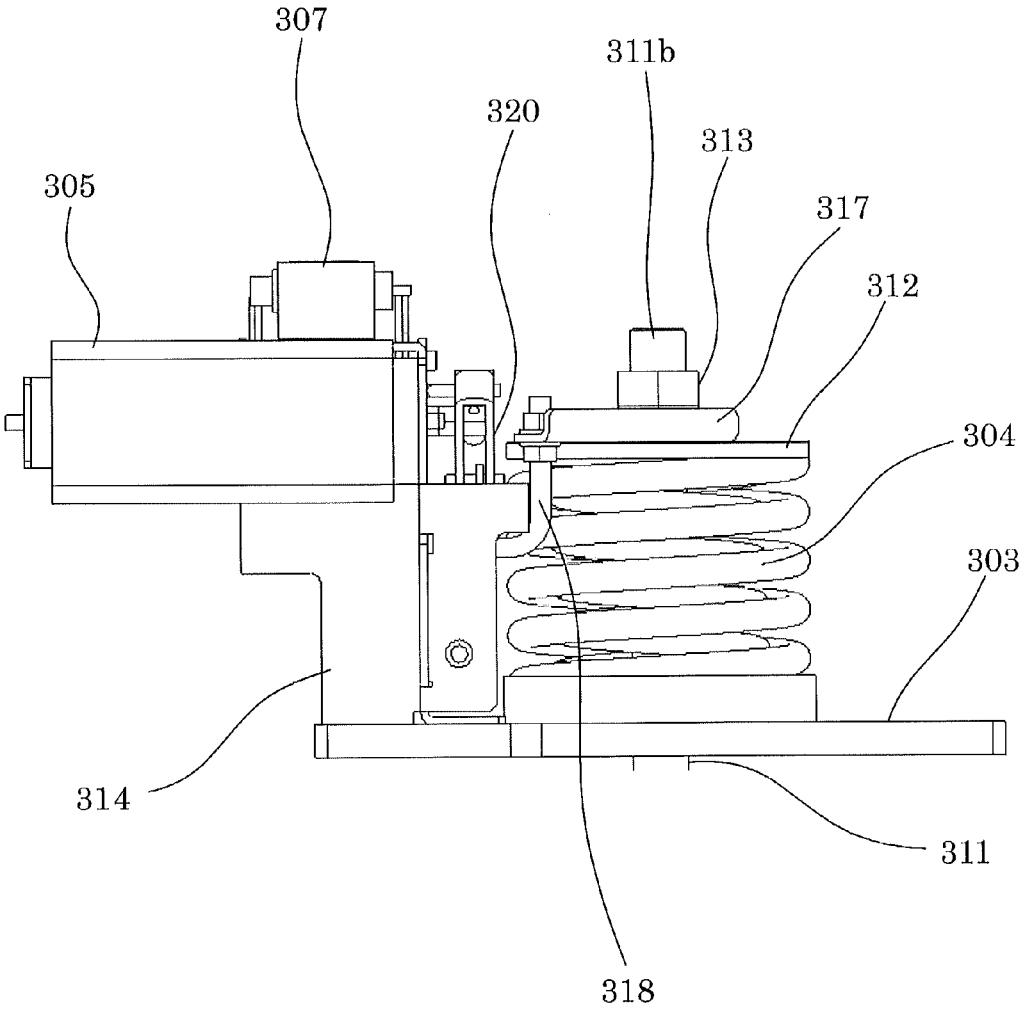
FIG. 4 is a bottom view showing the ON state in the electromagnetic operating device according to Embodiment 1 of the present invention.
Figure 5:
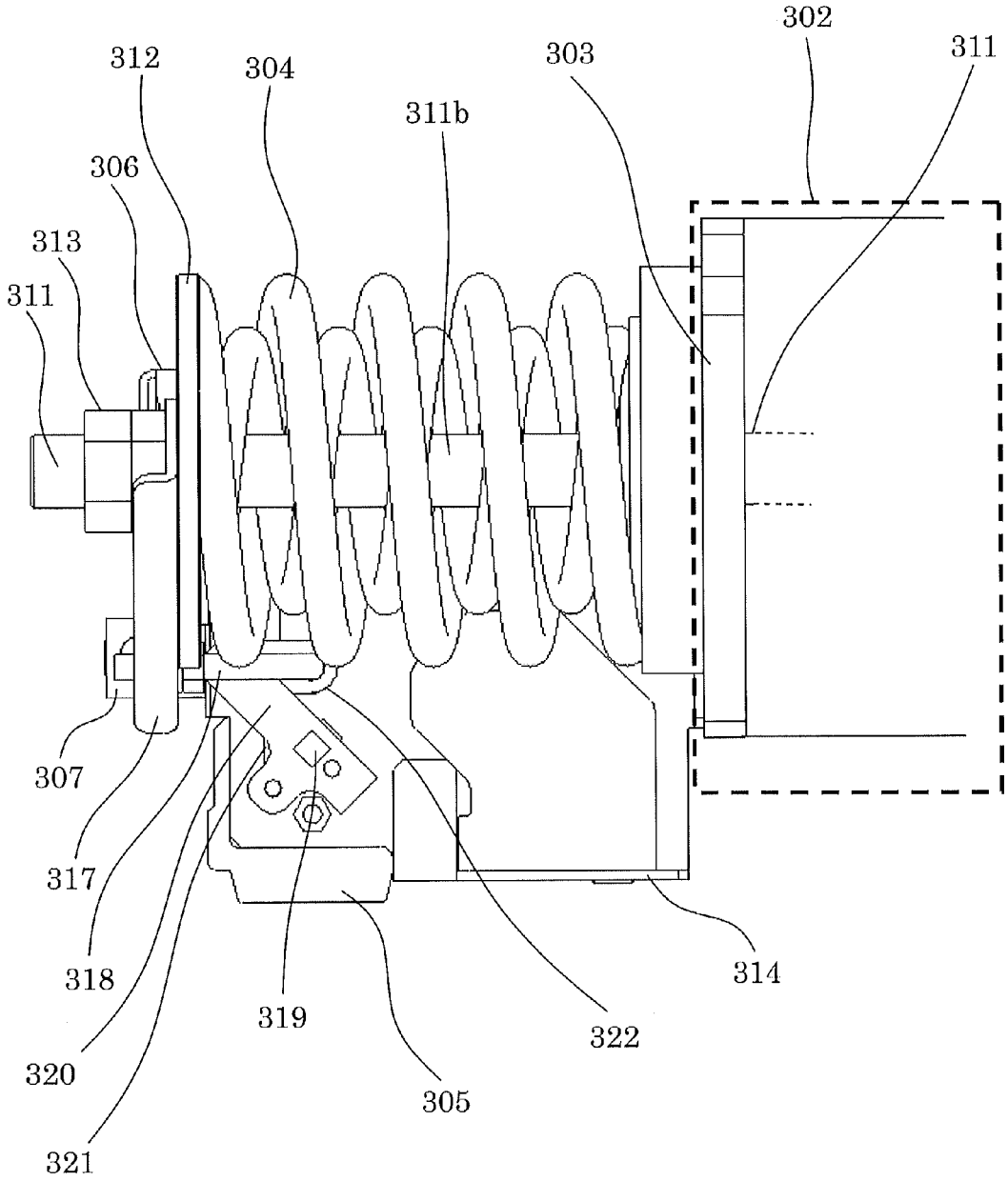
FIG. 5 is a side view showing an OFF state in the electromagnetic operating device according to Embodiment 1 of the present invention.
Figure 6:
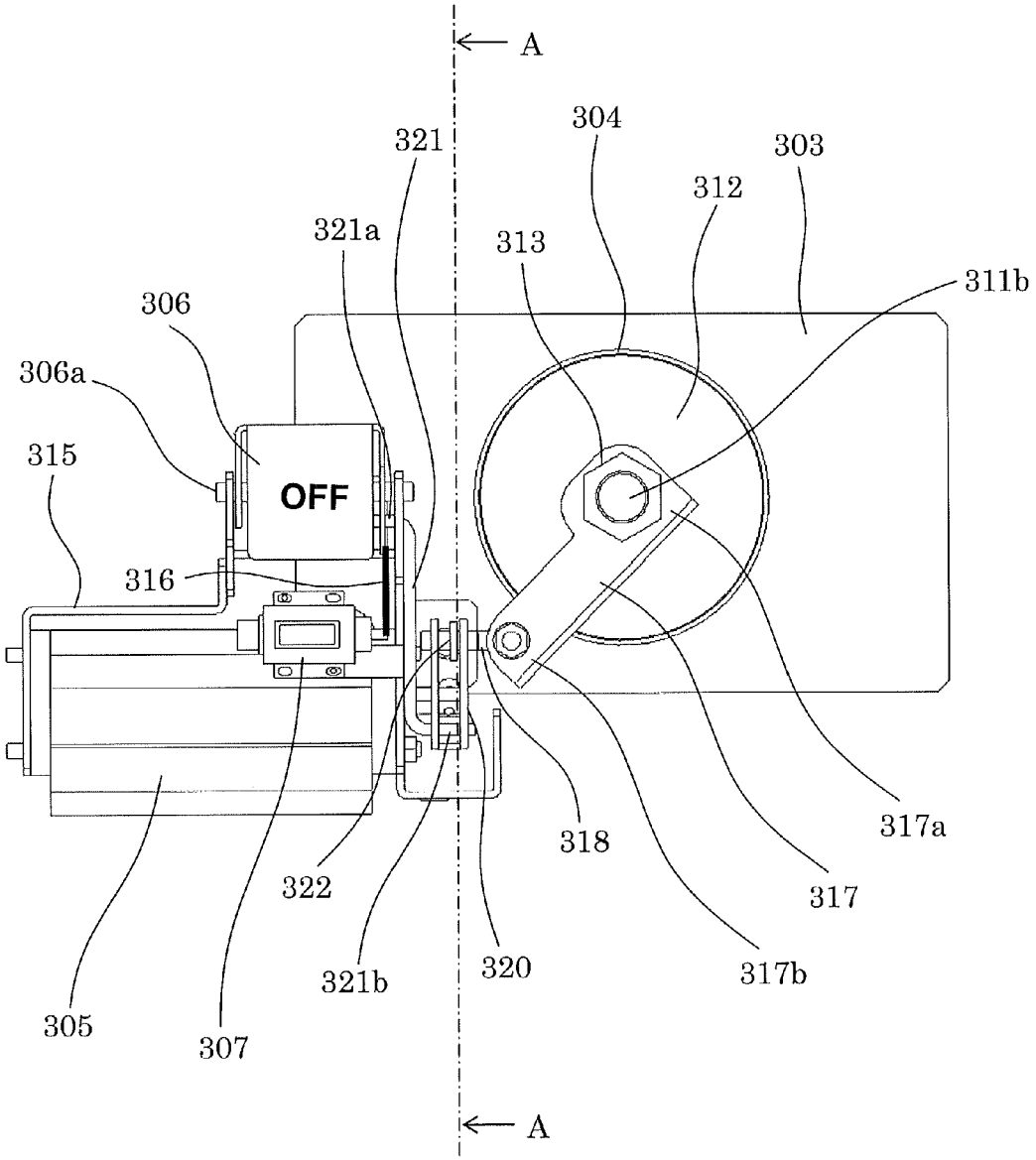
FIG. 6 is a front view showing the OFF state in the electromagnetic operating device according to Embodiment 1 of the present invention.
Figure 7:
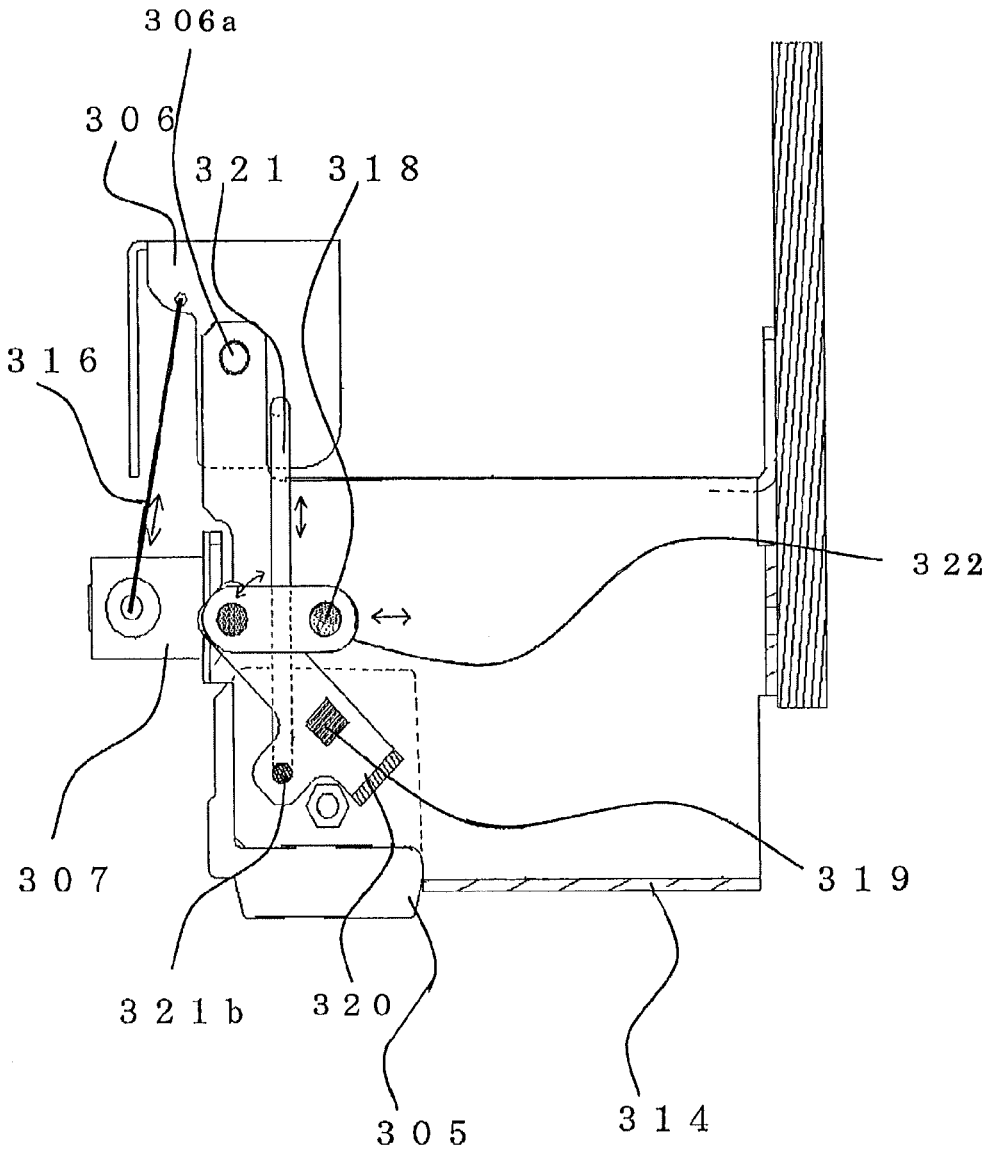
FIG. 7 is a sectional view taken along the line A-A of FIG. 6 of the electromagnetic operating device according to Embodiment 1 of the present invention.
Figure 8:
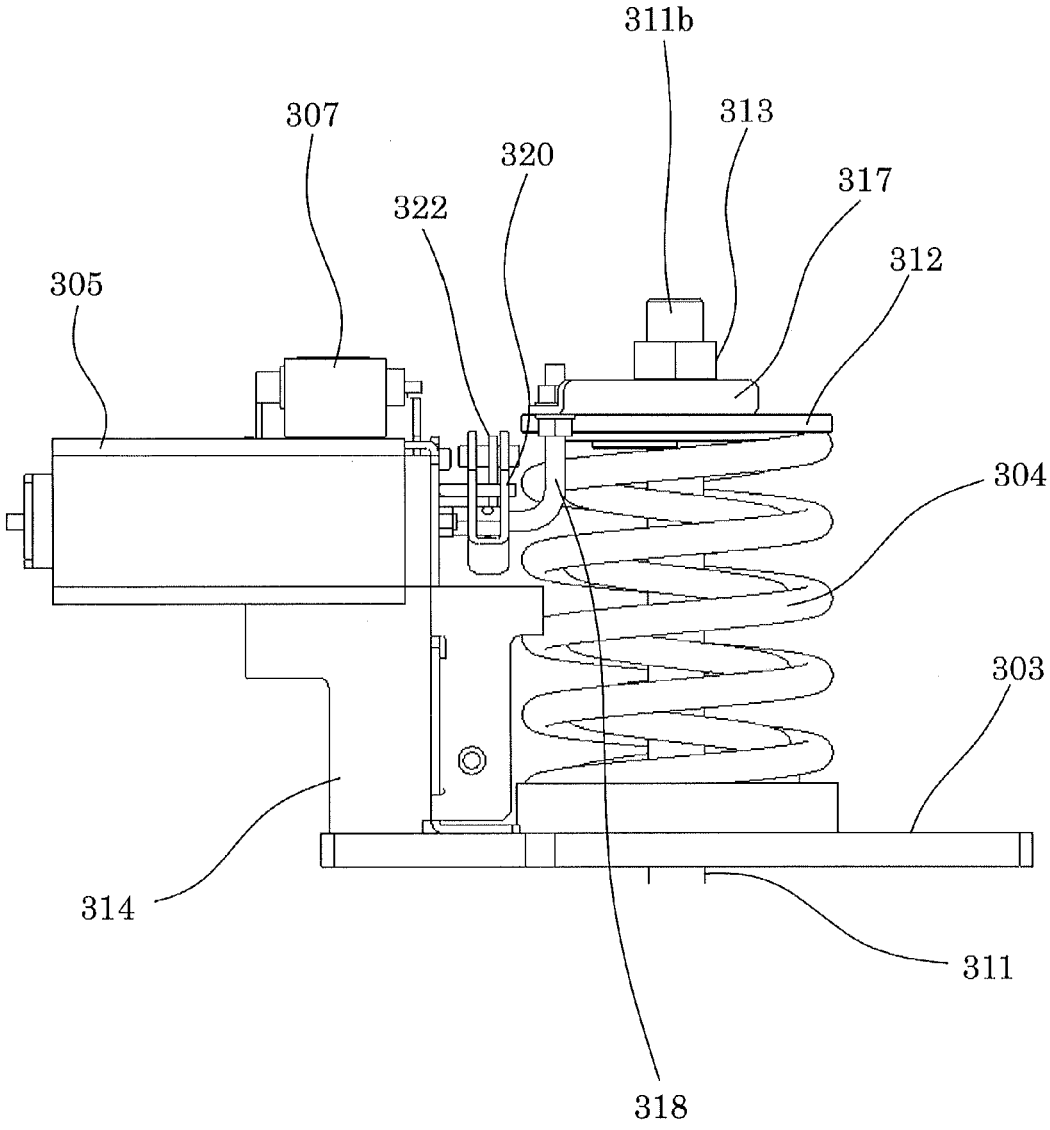
FIG. 8 is a bottom view showing the OFF state in the electromagnetic operating device according to Embodiment 1 of the present invention.
Figure 9:
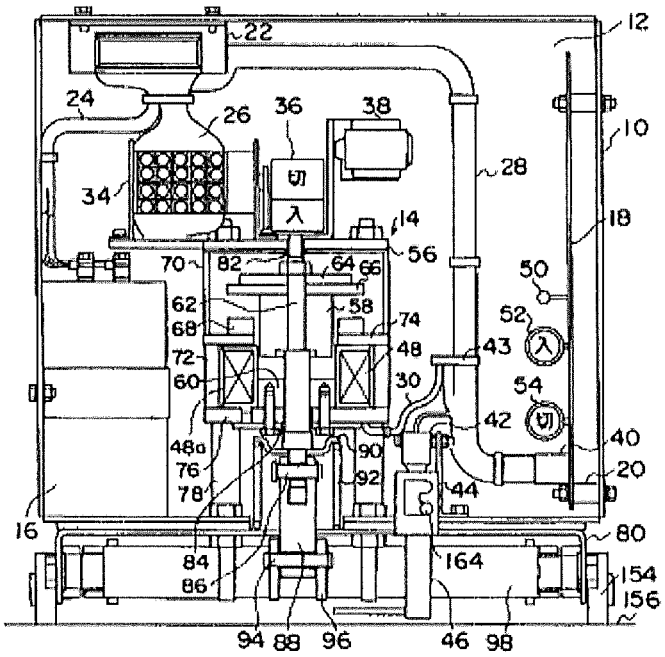
FIG. 9 is a front view showing a power switchgear equipped with a conventional electromagnetic operating device.
Figure 10:
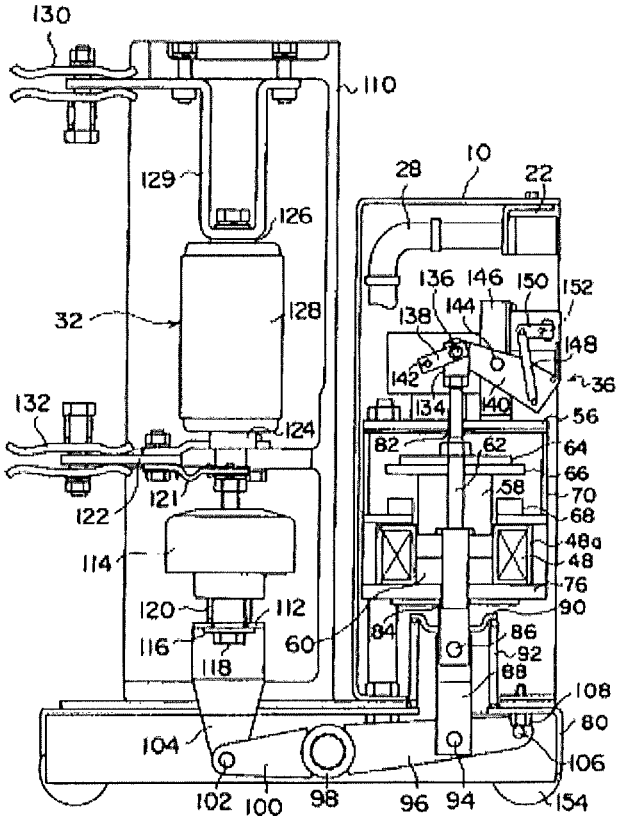
FIG. 10 is a side view showing the power switchgear equipped with the conventional electromagnetic operating device.

Hereinafter, Embodiment 1 of the present invention will be described with reference to FIG. 1 to FIG. 8. FIG. 1 is a side sectional view showing a circuit breaker equipped with an electromagnetic operating device according to Embodiment 1 of the present invention. FIG. 2 is a side view showing an ON state in the electromagnetic operating device according to Embodiment 1 of the present invention. FIG. 3 is a front view showing the ON state in the electromagnetic operating device according to Embodiment 1 of the present invention. FIG. 4 is a bottom view showing the ON state in the electromagnetic operating device according to Embodiment 1 of the present invention. FIG. 5 is a side view showing an OFF state in the electromagnetic operating device according to Embodiment 1 of the present invention. FIG. 6 is a front view showing the OFF state in the electromagnetic operating device according to Embodiment 1 of the present invention. FIG. 7 is a sectional view taken along the line A-A of FIG. 6 of the electromagnetic operating device according to Embodiment 1 of the present invention. FIG. 8 is a bottom view showing the OFF state in the electromagnetic operating device according to Embodiment 1 of the present invention.

In these respective drawings, reference numeral 201 denotes a ground tank whose axial direction is set, for example, in a horizontal direction; and an electromagnetic operating device 300 (to be described later) is disposed via a movable side covering plate 202 at a movable side end portion that is one end in the horizontal direction of the ground tank 201. The ground tank 201 is electrically grounded and insulating gas is filled inside thereof; and, for example, insulating gas such as dry air, nitrogen, or carbon dioxide, which is substantially zero in global warming potential and effective for global warming prevention, is filled as the insulating gas.

203 denotes a movable side insulation supporter which is disposed in the ground tank 201 at a movable side end portion that is one end in the horizontal direction in the ground tank 201; and 204 denotes a fixed side insulation supporter which is disposed in the ground tank 201 at a fixed side end portion that is the other end in the horizontal direction in the ground tank 201. 205 denotes a fixed side covering plate attached to a fixed side end portion that is the other end in the horizontal direction of the ground tank 201.

206 denotes a vacuum interrupter (vacuum circuit breaker) disposed in the ground tank 201; and a fixed side electrode 208 provided on a fixed side current-carrying shaft 207 and a movable side electrode 210 provided on a movable side current-carrying shaft 209 coaxially disposed with the fixed side current-carrying shaft 207 are configured to be capable of connecting and disconnecting. 211 denotes an insulation rod coupled to the movable side current-carrying shaft 209 of the vacuum interrupter 206.

212 denotes a movable side current transformer unit and is provided with a movable side current transformer 213 for measuring current. 214 denotes a fixed side current transformer unit and is provided with a fixed side current transformer 215 for measuring current.

216 denotes a movable side porcelain bushing; one side thereof is mounted on an upper portion of the movable side current transformer unit 212; and a movable side main circuit terminal 217 is attached to the other side thereof. 218 denotes a fixed side porcelain bushing; one side thereof is mounted on an upper portion of the fixed side current transformer unit 214; and a fixed side main circuit terminal 219 is attached to the other side thereof.

220 denotes a movable side main circuit conductor which passes through the movable side porcelain bushing 216 and the movable side current transformer unit 212; one side thereof is connected to the movable side conductor portion of the vacuum interrupter 206; and the other side thereof is connected to the movable side main circuit terminal 217 provided on the other side of the movable side porcelain bushing 216. 221 denotes a fixed side main circuit conductor which passes through the fixed side porcelain bushing 218 and the fixed side current transformer unit 214; one side thereof is connected to the fixed side conductor portion of the vacuum interrupter 206; and the other side thereof is connected to the fixed side main circuit terminal 219 provided on the other side of the fixed side porcelain bushing 218.

222 denotes a movable side insulator which is provided around the movable side main circuit conductor 220. 223 denotes a fixed side insulator which is provided around the fixed side main circuit conductor 221.

224 denotes a movable side ground shield which is longitudinally disposed in the movable side insulator 222; a lower side end portion of the movable side ground shield 224 is provided extending further downward than the lower end of the movable side current transformer unit 212; and an upper side end portion of the movable side ground shield 224 is provided extending further upward than the upper end of the movable side current transformer unit 212. 225 denotes a fixed side ground shield which is longitudinally disposed in the fixed side insulator 223; a lower side end portion of the fixed side ground shield 225 is provided extending further downward than the lower end of the fixed side current transformer unit 214; and an upper side end portion of the fixed side ground shield 225 is provided extending further upward than the upper end of the fixed side current transformer unit 214.

226 denotes a movable side electric field relaxation ring which is provided on the lower side end portion and the upper side end portion of the movable side ground shield 224, respectively. 227 denotes a fixed side electric field relaxation ring which is provided on the lower side end portion and the upper side end portion of the fixed side ground shield 225, respectively.

300 denotes the electromagnetic operating device which is disposed on the movable side end portion that is one end in the horizontal direction of the ground tank 201 via the movable side covering plate 202 and is incorporated in an operating box 301. The electromagnetic operating device 300 is coaxially coupled to the insulation rod 211.

The electromagnetic operating device 300 is fundamentally composed of an electromagnet mechanism 302 and components mounted on an opening side end plate 303 of the electromagnet mechanism 302, the components being an interrupting spring 304, an auxiliary contact 305, an ON/OFF indicator 306, and an operation counter 307.

The electromagnet mechanism 302 includes a movable core 308, a fixed core 309, an electromagnetic coil 310, an driving rod 311, and the like. The driving rod 311 is disposed at an axial central portion of the movable core 308 and is coaxially disposed with the insulation rod 211; one side 311*a* of the driving rod 311 is coaxially coupled to the insulation rod 211; and the other side 311*b* of the driving rod 311 is disposed extending further on the opening side than the opening side end plate 303 of the electromagnet mechanism 302. Incidentally, a leading end portion of one side 311*a* of the driving rod 311 is formed in a male screw, which is attachably and detachably engaged with the other side shaft 230 formed in a female screw.

The interrupting spring 304 is passed through by the other side 311*b* of the driving rod 311 which is disposed extending further on the opening side than the opening side end plate 303 of the electromagnet mechanism 302. Then, the interrupting spring 304 is received by an interrupting spring receiver 312 and is engaged with a nut 313 and the interrupting spring receiver 312 at a predetermined position.

The auxiliary contact 305 is attached to the opening side end plate 303 of the electromagnet mechanism 302 via, for example, a support plate 314. Incidentally, the auxiliary contact 305 may be directly attached to the opening side end plate 303 of the electromagnet mechanism 302.

The ON/OFF indicator 306 is configured to be attached in the vicinity of, for example, the auxiliary contact 305 via a support plate 315 so as to indicate ON/OFF states by pivoting by an ON/OFF indicator pivoting shaft 306*a*. Incidentally, the ON/OFF indicator 306 may be directly attached to the opening side endplate 303 of the electromagnet mechanism 302.

The operation counter 307 is disposed in the vicinity of, for example, the auxiliary contact 305 and the ON/OFF indicator 306. Then, an operation counter driver 316 coupled to the operation counter 307 and the ON/OFF indicator 306 is provided. The operation counter driver 316 is configured by a spring structure to suppress, for example, a shock due to ON/OFF operation of the ON/OFF indicator 306 from being transmitted to the operation counter 307. The operation counter 307 is operated and counted by the operation counter driver 316 in response to ON/OFF operation of the ON/OFF indicator 306.

One side 317*a* of a driving plate 317 is passed through by the other side 311*b* of the driving rod 311 to be attached to the side of the interrupting spring receiver 312 with the nut 313; and the other side 317*b* of the driving plate 317 is coupled to a driving rod 318.

ON/OFF operation of the auxiliary contact 305 is performed by an auxiliary contact lever 320 which is engaged with the driving rod 318 and rotates centering on the auxiliary contact rotational shaft 319 by the driving rod 318. Incidentally, the driving rod 318 and the auxiliary contact lever 320 are connected to be engaged by a connection plate 322.

ON/OFF indication operation of the ON/OFF indicator 306 is performed by the ON/OFF indicator driving rod 321; one side 321*a* is coupled to the ON/OFF indicator 306; and the other side 321*b* is coupled to the auxiliary contact lever 320. Then, the operation counter 307 is operated and counted by the operation counter driver 316 in response to ON/OFF operation of the ON/OFF indicator 306.

Next, operation will be described. FIG. 1 to FIG. 4 each shows an energized state where the vacuum interrupter 206 is closed by the electromagnet mechanism 302 of the electromagnetic operating device 300 and the movable side electrode 210 and the fixed side electrode 208 are in a close-circuit state.

More specifically, by excitation to the suction side of the electromagnetic coil 310 of the electromagnet mechanism 302, the movable core 308 is suctioned to the fixed core 309 side to move in a direction in which the movable side electrode 210 and the fixed side electrode 208 are close-circuited; and the driving rod 311 also moves in the direction in which the movable side electrode 210 and the fixed side electrode 208 are close-circuited together with the movement of the movable core 308.

The driving rod 311 moves in the direction in which the movable side electrode 210 and the fixed side electrode 208 are close-circuited; and thus, the interrupting spring 304, which is passed through by the other side 311*b* of the driving rod 311 disposed extending further on the opening side than the opening side end plate 303 of the electromagnet mechanism. 302, is compressed by the interrupting spring receiver 312 that moves in the same direction in conjunction with the driving rod 311 as shown in FIG. 2.

The driving rod 318, which is coupled to the other Side 317*b* of the driving plate 317 attached to the interrupting spring receiver 312, also moves in the same direction by the movement of the interrupting spring receiver 312. By the movement of this driving rod 318, the auxiliary contact lever 320 engaged with the driving rod 318 rotates, for example, in the clockwise direction centering on the auxiliary contact rotational shaft 319. When the auxiliary contact lever 320 rotates to a position shown in FIG. 2, the auxiliary contact 305 becomes a contact state of an ON state and the contact state of the ON state is output by an electrical signal.

When the auxiliary contact lever 320 rotates in the clockwise direction centering on the auxiliary contact rotational shaft 319, the ON/OFF indicator driving rod 321 coupled to the auxiliary contact lever 320 is pushed up to the upper side and ON/OFF indication operation of the ON/OFF indicator 306 is performed by one side 321*a* of the ON/OFF indicator driving rod 321. Then, as shown in FIG. 3, the ON/OFF indicator pivoting shaft 306*a* pivots and the ON state is indicated to be able to confirm visually.

At the same time as the ON state is indicated by the ON/OFF indicator 306, the operation counter 307 is operated in response to the indication of the ON state of the ON/OFF indicator 306 by the operation counter driver 316 coupled to the operation counter 307 and the ON/OFF indicator 306, and the number of closing times of the vacuum interrupter 206 is counted and indicated.

Next, FIG. 5 to FIG. 8 each shows a non-energized state where the vacuum interrupter 206 is interrupted by the electromagnet mechanism 302 of the electromagnetic operating device 300 and the movable side electrode 210 and the fixed side electrode 208 are in an open-circuit state.

More specifically, by excitation to the separation side of the electromagnetic coil 310 of the electromagnet mechanism 302, the movable core 308 is separated from the fixed core 309 side to move in a direction in which the movable side electrode 210 and the fixed side electrode 208 are open-circuited; and the electromagnetic operation rod 311 also moves in the direction in which the movable side electrode 210 and the fixed side electrode 208 are open-circuited together with the movement of the movable core 308.

The driving rod 311 moves in the direction in which the movable side electrode 210 and the fixed side electrode 208 are open-circuited; and thus, the interrupting spring 304, which is passed through by the other side 311*b* of the driving rod 311 disposed extending further on the opening side than the opening side end plate 303 of the electromagnet mechanism. 302, is opened by the interrupting spring receiver 312 that moves in the same direction in conjunction with the driving rod 311 as shown in FIG. 5 and a compressed state of the interrupting spring 304 is released.

The driving rod 318, which is coupled to the other side 317*b* of the driving plate 317 attached to the interrupting spring receiver 312, also moves in the same direction by the movement of the interrupting spring receiver 312. By the movement of this driving rod 318, the auxiliary contact lever 320 engaged with the driving rod 318 rotates, for example, in the counterclockwise direction centering on the auxiliary contact rotational shaft 319. When the auxiliary contact lever 320 rotates to a position shown in FIG. 5, the auxiliary contact 305 becomes a contact state of an OFF state and the contact state of the OFF state is output by an electrical signal.

When the auxiliary contact lever 320 rotates in the counterclockwise direction centering on the auxiliary contact rotational shaft 319, the ON/OFF indicator driving rod 321 coupled to the auxiliary contact lever 320 is pushed down to the lower side and ON/OFF indication operation of the ON/OFF indicator 306 is performed by one side 321*a* of the ON/OFF indicator driving rod 321. Then, as shown in FIG. 6, the ON/OFF indicator pivoting shaft 306*a* pivots in the counterclockwise direction and the OFF state is indicated to be able to confirm visually.

At the same time as the OFF state is indicated by the ON/OFF indicator 306, it becomes a standby state of the next operation of the operation counter 307 in response to the indication of the OFF state of the ON/OFF indicator 306 by the operation counter driver 316 coupled to the operation counter 307 and the ON/OFF indicator 306.

Further, when the transition from the open-circuit state to the close-circuit state of the vacuum interrupter 206, that is, a closing command of the vacuum interrupter 206 is output, by excitation to the suction side of the electromagnetic coil 310 of the electromagnet mechanism 302, the movable core 308 is suctioned to the fixed core 309 side to move in the direction in which the movable side electrode 210 and the fixed side electrode 208 are close-circuited; and the driving rod 311 also moves in the direction in which the movable side electrode 210 and the fixed side electrode 208 are close-circuited together with the movement of the movable core 308.

The driving rod 311 moves in the direction in which the movable side electrode 210 and the fixed side electrode 208 are close-circuited; and thus, the interrupting spring 304, which is passed through by the other side 311*b* of the driving rod 311 disposed extending further on the opening side than the opening side end plate 303 of the electromagnet mechanism. 302, is compressed by the interrupting spring receiver 312 that moves in the same direction in conjunction with the driving rod 311 as shown in FIG. 2.

The driving rod 318, which is coupled to the other side 317*b* of the driving plate 317 attached to the interrupting spring receiver 312, also moves in the same direction by the movement of the interrupting spring receiver 312. By the movement of this driving rod 318, the auxiliary contact lever 320 engaged with the driving rod 318 via the connection plate 322 rotates, for example, in the clockwise direction centering on the auxiliary contact rotational shaft 319. When the auxiliary contact lever 320 rotates to the position shown in FIG. 2, the auxiliary contact 305 becomes a contact state of an ON state and the contact state of the ON state is output by an electrical signal.

When the auxiliary contact lever 320 rotates in the clockwise direction centering on the auxiliary contact rotational shaft 319, the ON/OFF indicator driving rod 321 coupled to the auxiliary contact lever 320 is pushed up to the upper side and ON/OFF indication operation of the ON/OFF indicator 306 is performed by one side 321*a* of the ON/OFF indicator driving rod 321. Then, as shown in FIG. 3, the ON/OFF indicator pivoting shaft 306*a* pivots and the ON state is indicated to be able to confirm visually.

At the same time as the ON state is indicated by the ON/OFF indicator 306, the operation counter 307 is operated in response to the indication of the ON state of ON/OFF indicator 306 by the operation counter driver 316 coupled to the operation counter 307 and the ON/OFF indicator 306, and the number of closing times of the vacuum interrupter 206 is counted and indicated.

The above described operation is repeatedly performed; and thus, a closing state of the vacuum valve 206 is output by the auxiliary contact 305 by the electrical signal and is indicated by the ON/OFF indicator 306. Furthermore, the number of closing times of the vacuum interrupter 206 is counted and indicated by the operation counter 307.

According to the aforementioned Embodiment 1, the electromagnetic operating device 300 is provided corresponding to the vacuum interrupter 206 of each phase, respectively; and not only the auxiliary contact 305, the ON/OFF indicator 306, and the operation counter 307 but also the interrupting spring 304 is provided on the opening side end plate 303 of the electromagnet mechanism 302; and thus, commoditizing of mounting plate members is achieved and a reduction in the number of components can be achieved.

Furthermore, the vacuum interrupter 206 and the components mounted on the opening side end plate 303 of the electromagnet mechanism 302, the components being the auxiliary contact 305, the ON/OFF indicator 306, the operation counter 307, and the interrupting spring 304 are configured in an independent single phase for each phase; and thus, assembly and adjustment work can be performed for each unit of each phase, workability is excellent, productivity is improved, and a reduction in cost can be achieved. Besides, the manufacturing can be made in a separate process from the vacuum interrupter 206. In addition, adjustment of the interrupting spring 304 can be independently and easily performed for each phase and simplification of the manufacturing process can also be achieved.

Further, the vacuum interrupter 206 and the components mounted on the opening side end plate 303 of the electromagnet mechanism 302, the components being the auxiliary contact 305, the ON/OFF indicator 306, the operation counter 307, and the interrupting spring 304 are configured in the independent single phase for each phase; and thus, not only application to the three phase vacuum interrupters 206 but also application to a single phase circuit breaker can be easily made.

Moreover, the auxiliary contact can be provided for each phase and the configuration of an auxiliary contact for an open phase discrimination circuit is easy.

By the way, in the aforementioned Embodiment 1, the description has been made on the case where the electromagnetic operating device is applied to a power switchgear equipped with, for example, a tank type vacuum circuit breaker for use in electric power transmission/distribution of electric power facilities, electric power reception facilities, and the like; however, the present invention is not limited to this, but it goes without saying that the electromagnetic operating device in this Embodiment 1 can be applied to other circuit breakers and similar effects to the aforementioned Embodiment 1 can be exhibited.

INDUSTRIAL APPLICABILITY

The present invention is suitable for actualizing an electromagnetic operating device capable of achieving a reduction in size and capable of dealing with a single phase and three phases.

The invention claimed is:

1. An electromagnetic operating device comprising:

an electromagnet mechanism which performs opening and closing operation of a circuit breaker and is coaxially disposed with a vacuum interrupter that is disposed in said circuit breaker, and which has a movable core and a fixed core arranged facing with each other and has an electromagnetic coil that makes said movable core and said fixed core separate or come into contact in response to electromagnetic force;

a driving rod which is movably disposed in the axial direction of said electromagnet mechanism and is coupled to said movable core, and in which one side is coupled to said circuit breaker and the other side passes through an opening side end plate of said electromagnet mechanism to be extended outward from said opening side end plate of said electromagnet mechanism along a longitudinal central axis of the driving rod;

an interrupting spring that is held at a predetermined position on a side of said opening side end plate of said electromagnet mechanism; and an indication unit which is disposed on the same side of said opening side end plate of said electromagnet mechanism as said interrupting spring and which is offset from the longitudinal central axis of the driving rod, and indicates a state of said circuit breaker in conjunction with the movement of said driving rod.

2. The electromagnetic operating device according to claim 1, wherein said indication unit includes:

an ON/OFF indicator which indicates ON/OFF states of said circuit breaker; and an operation counter which counts the number of times of an ON state of said circuit breaker, and said interrupting spring is passed through by the other side of said driving rod, and is held at the predetermined position on said opening side end plate of said electromagnet mechanism by an interrupting spring receiver; and the electromagnetic operating device further comprises:

an auxiliary contact which is disposed on said opening side end plate of said electromagnet mechanism, and opens and closes in conjunction with the movement of said driving rod.

3. The electromagnetic operating device according to claim 2, further comprising:

a driving plate which is passed through by the other side of said driving rod and is attached to the side of said interrupting spring receiver to move in conjunction with the movement of said driving rod;

a driving rod which is coupled to said driving plate to move in conjunction with the movement of said driving plate;

an auxiliary contact lever which is engaged with said driving rod to perform opening and closing operation of said auxiliary contact;

an ON/OFF indicator driving rod which is coupled to said auxiliary contact lever to operate ON/OFF indication of said ON/OFF indicator; and an operation counter driver which operates said operation counter in response to ON/OFF operation of said ON/OFF indicator.

4. The electromagnetic operating device according to claim 2, wherein said circuit breaker is configured in three phases; and said electromagnet mechanism, said driving rod, said interrupting spring, said auxiliary contact, said ON/OFF indicator, and said operation counter are arranged corresponding to each of the phases.

5. The electromagnetic operating device according to claim 3, wherein said circuit breaker is configured in three phases; and said electromagnet mechanism, said driving rod, said interrupting spring, said auxiliary contact, said ON/OFF indicator, and said operation counter are arranged corresponding to each of the phases.

6. The electromagnetic operating device according to claim 2, wherein said circuit breaker is configured in a single phase; and said electromagnet mechanism, said driving rod, said interrupting spring, said auxiliary contact, said ON/OFF indicator, and said operation counter are arranged in said circuit breaker.

7. The electromagnetic operating device according to claim 3, wherein said circuit breaker is configured in a single phase; and said electromagnet mechanism, said driving rod, said interrupting spring, said auxiliary contact, said ON/OFF indicator, and said operation counter are arranged in said circuit breaker.

8. The electromagnetic operating device according to claim 1, wherein said circuit breaker is configured in a vacuum interrupter.

* * * * *